US011225819B2

(12) United States Patent
Oakley et al.

(10) Patent No.: US 11,225,819 B2
(45) Date of Patent: Jan. 18, 2022

(54) DOOR OPERATING SYSTEM

(71) Applicant: MOTIONACCESS, L.L.C., Elk Grove Village, IL (US)

(72) Inventors: Robert L. Oakley, Chicago, IL (US); Joseph P. Madden, Des Plaines, IL (US)

(73) Assignee: MOTTONACCESS, LLC., Elk Grave Village, IL (US)

( * ) Notice: Subject to any disclaimer, the term of this patent is extended or adjusted under 35 U.S.C. 154(b) by 0 days.

(21) Appl. No.: 16/857,582

(22) Filed: Apr. 24, 2020

(65) Prior Publication Data

US 2020/0340284 A1 Oct. 29, 2020

Related U.S. Application Data

(60) Provisional application No. 62/838,902, filed on Apr. 25, 2019.

(51) Int. Cl.
*E05F 15/00* (2015.01)
*E05F 15/611* (2015.01)

(52) U.S. Cl.
CPC ..... *E05F 15/611* (2015.01); *E05Y 2201/214* (2013.01); *E05Y 2201/41* (2013.01); *E05Y 2201/422* (2013.01); *E05Y 2201/624* (2013.01); *E05Y 2201/686* (2013.01); *E05Y 2201/706* (2013.01); *E05Y 2201/71* (2013.01); *E05Y 2900/132* (2013.01)

(58) Field of Classification Search
CPC .... E05F 15/63; E05F 15/611; E05Y 2201/41; E05Y 2201/71; E05Y 2201/214; E05Y 2201/686; E05Y 2201/422; E05Y 2201/216; E05Y 2201/706; E05Y 2201/624; E05Y 2600/12; E05Y 2800/298; E05Y 2800/33; E05Y 2900/132; E05Y 2201/718; E05Y 2201/72
USPC ..... 49/349, 506, 358; 16/49; 700/275
See application file for complete search history.

(56) References Cited

U.S. PATENT DOCUMENTS 5,666,692 A * 9/1997 Toledo ..... E05F 3/104 16/51
5,878,530 A * 3/1999 Eccleston ..... E05F 15/77 49/139
6,338,693 B1 * 1/2002 Scholten ..... E05F 15/614 477/7
6,539,669 B1 * 4/2003 Heidrich ..... B61D 19/008 49/120

(Continued)

*Primary Examiner* — Chi Q Nguyen
(74) *Attorney, Agent, or Firm* — Law Office of John W. Harbst

(57) ABSTRACT

A door operating system for moving a door about a vertical pivot axis between a closed position and an open position. The door operating system includes a driver including a free-ended output shaft and linkage for operably connecting the output shaft of the driver with door. An adjustable and selectively operable coupling is disposed between the free-end of the output shaft of the driver and the linkage. The adjustable coupling has a pair of coaxially spaced and adjustable interfaces. A first adjustable interface is defined between the free-end of the output shaft and the coupling while a second adjustable interface is defined between the coupling and the linkage whereby allowing for a high resolution, angular adjustment of the position of the door.

24 Claims, 7 Drawing Sheets

(56) References Cited

U.S. PATENT DOCUMENTS

| | | | | |
|---|---|---|---|---|
| 6,598,539 | B2 * | 7/2003 | Oakley | B61D 19/02 105/343 |
| 6,634,140 | B1 * | 10/2003 | Sellman | E05F 15/41 49/340 |
| 6,684,567 | B2 * | 2/2004 | Heidrich | B61D 19/008 49/213 |
| 7,318,096 | B2 * | 1/2008 | Koch | H04L 29/12009 709/223 |
| 7,418,800 | B1 * | 9/2008 | Sellman | E05F 15/63 192/18 B |
| 2006/0244271 | A1 * | 11/2006 | Hass | E05F 15/63 292/336.3 |
| 2012/0029701 | A1 * | 2/2012 | Houser | E05F 15/63 700/275 |
| 2019/0119964 | A1 * | 4/2019 | Hau | E05F 15/624 |
| 2019/0119971 | A1 * | 4/2019 | Staehlin | E05F 15/63 |

* cited by examiner

DOOR OPERATING SYSTEM

RELATED APPLICATION

This patent application is related to co-assigned and co-pending U.S. PROVISIONAL patent application Ser. No. 62/838,902, filed Apr. 25, 2019; the entirety of which is incorporated herein by reference.

FIELD OF THE INVENTION DISCLOSURE

This invention disclosure generally relates to a door which moves about a generally vertical axis between open and closed positions and, more specifically, to a system for operating such a door between the open and closed positions.

BACKGROUND

Doors which swing about a vertical pivot axis as they move between open and closed positions are commonly used as entryway doors in any of a variety of different situations including ingress and egress to and from various locations. In some situations, such doors are typically operated by a driver having an output shaft and a linkage used to operably connect the output shaft of the driver to the door.

In some applications, an interface is established between the output shaft and the linkage In one form, such an interface includes a series of finely serrated teeth between the output shaft of the driver and the linkage. In some situations, and for any of a variety of different reasons, the open position of the door requires adjustment. The ability to adjust the open position of the door is particularly important when an adjacent wall of the facility is disposed proximate to or generally parallel to the open position of the door. Of course, in many situations, it is desired to maximize the door opening by having the door swing to a fully open position and, yet, not contact the adjacent wall.

As will readily appreciated by those skilled in the art, the linkage between the output shaft of the driver and the door frequently includes a crank arm connected to the output shaft of the driver. In these situations, and when moving the door from the closed position to the open position, the output shaft of the driver places a significant amount of torque on and to the crank arm of the linkage. The forces applied to the joinder between the output shaft of the driver and the crank arm are further amplified by the desired rapidity at which the door opens from a closed position. As is evident from today's increased need for speed, the desire for a door to open from the closed position is ever increasing. Unfortunately, the finely serrated teeth on the interface between the output shaft and the crank arm frequently cannot transfer the ever increasing torque levels between the output shaft of the driver and the crank arm. As such, those finely serrated teeth tend to wear and become stripped, thus, resulting in slippage between the output shaft of the driver and the crank arm. Accordingly, a repair person needs to be called to repair the worn and frequently inoperable door system. The repair of a worn and frequently inoperable door system can be costly and time sensitive since the door requiring repair is typically out of service during the entirety of the time the repairs are being performed thereon.

Thus, there is a need and a desire for a simple, cost effective and yet efficient system for operably and positively moving a door from a closed to an open position, which readily allows for adjustment of the open position of the door, and which is constructed to withstand high levels of torque being repeatedly and consistently applied thereto.

SUMMARY

According to one aspect of this invention disclosure, there is provided a door operating system for moving a door about a vertical pivot axis between a closed position and an open position. As is known, and according to one aspect of the invention disclosure, the door operating system includes a driver including a free-ended output shaft and linkage operably connecting the output shaft of the driver to the door. An adjustable and selectively operable coupling is disposed between the free-end of the output shaft of the driver and the linkage. The adjustable coupling has a pair of coaxially spaced and adjustable interfaces. A first adjustable interface is defined between the free-end of the output shaft and the coupling while a second adjustable interface is defined between the coupling and the linkage whereby allowing for a high resolution, angular adjustment of the door.

In one form, the free-end of the output shaft defines a first end face extending generally normal to an axis defined by the output shaft of the driver. Also, the linkage preferably defines a second end face extending generally normal to the axis defined by the output shaft of the driver. In a preferred embodiment, the coupling defines a ring selectively rotatable about the axis defined by the output shaft of the driver. The ring has third and fourth axially spaced end faces thereon.

In one embodiment, the first adjustable interface defined between the free-end of the output shaft and the coupling includes a predetermined number of engagement features on the end face of the output shaft and which are configured to engage corresponding engagement features on the first surface of the coupling. In this embodiment, the second adjustable interface defined between the coupling and the linkage includes a predetermined number of engagement features on the end face of linkage and which are configured to engage corresponding engagement features on the second surface of the coupling. To affect the desired ends, the predetermined number of engagement features on the end face of the output shaft which engage with the corresponding engagement features on the first surface of the coupling is different in number than the predetermined number of engagement features on the end face of the linkage which engage corresponding engagement features on the second surface of the coupling.

Preferably, the engagement features included with the first and second interfaces comprise a series of equally spaced radial and intermeshing teeth. Each tooth included with the first and second interfaces preferably involves a symmetrical serration having two load bearing surfaces each angled at about 60 degrees relative to the respective surface from which the serration extends.

According to another aspect of this invention disclosure, there is provided a door operating system for repeatedly and consistently moving a door about a stationary pivot axis between a closed position and an open position. According to this aspect of the invention disclosure, the door operating system includes a driver including a positively driven free-ended output shaft and linkage for operably connecting the driver to the door. An adjustable coupling is disposed between the free-end of the output shaft of the driver and the linkage. The adjustable coupling has a pair of coaxially spaced interfaces. A first adjustable interface includes a first set of interlocking instrumentalities defined between the free-end of the output shaft and the coupling. Elements of the first set of interlocking instrumentalities are mutually engagable in a plurality of first distinct angularly indexed positions about the axis about which the door pivots and with the first angularly indexed positions having a first angular separation therebetween. The second adjustable interface includes a second set of interlocking instrumentalities defined between the coupling and the linkage. Elements of the second set of interlocking instrumentalities are mutually engagable in a plurality of second distinct angularly indexed positions about the axis about which the door pivots, and with the second angularly indexed positions having a second angular separation different from the first angular separation whereby allowing for a high angular resolution of the position of the door.

According to this aspect of the invention disclosure, the elements of the first and second sets of interlocking instrumentalities are mutually engageable and disengageable by means of relative axial movement of the coupling along the axis of the output shaft. Preferably, the elements of the first interlocking instrumentalities are provided by identical elements on an end face of the output shaft of the drive and by a confronting surface on the coupling. In a preferred form, the elements of the first interlocking instrumentalities include a series of equally spaced and radially directed teeth. In this form of the invention disclosure, the elements of the second interlocking instrumentalities are provided by identical elements on confronting surfaces defined by the coupling and the crank arm. In this form, the elements of the second interlocking instrumentalities include a series of equally spaced and radially directed teeth.

Preferably, the coupling defines a ring selectively rotatable about the fixed axis defined by the output shaft of the driver. Furthermore, a circumference of the ring preferably includes indicia for visually indicating the indexed position of the coupling.

According to another aspect of this invention disclosure, there is provided a door operating system for repeatedly moving a door about a stationary pivot axis between a closed position and an open position. The door operating system includes a driver including a positively driven free-ended output shaft and linkage including a generally L-shaped crank arm operably connected to and extending from the door toward the free-end of the output shaft. An adjustable coupling is disposed between the free-end of the output shaft of the driver and the crank arm. The adjustable coupling has a pair of coaxially spaced interfaces. A first adjustable and course toothed interface is defined between the free-end of the output shaft and the coupling. A second adjustable and course toothed interface is defined between the coupling and the crank arm whereby allowing for angular adjustment of the open position of the door as a function of the adjusted position of the coupling relative to the output shaft and the crank arm.

Preferably, the first toothed interface includes a first predetermined number of radially and equally spaced teeth on an end face of the output shaft and an equal number of radially and equally spaced teeth on a first surface of the coupling. In a preferred embodiment, the second toothed interface includes a second predetermined number of radially and equally spaced teeth on a second surface of the coupling and an equal number of radially and equally spaced teeth on said crank arm. To advantageously affect the desired ends of this invention disclosure, the first and second predetermined number of teeth on the first and second interfaces are not equal to each other whereby allowing for angular adjustment of the open position of the door as a function of the adjusted position of the coupling relative to the output shaft and the crank arm. In a preferred embodiment of the door operating system, the course teeth of the first and second interfaces are mutually engageable and disengageable by means of relative axial movement of the coupling along the axis defined by the output shaft.

In one form, the door operating system also preferably includes a locking mechanism for conditioning the door operating system in either a locked condition, wherein the teeth of the first and second interfaces are maintained in releasably locked intermeshing relation relative to each other whereby allowing force transfer therebetween, and an unlocked condition. Preferably, the coupling also defines a ring selectively rotatable about the axis defined by the output shaft. To facilitate operation, a circumference of the ring forming part of the coupling includes indicia for visually indicating the indexed position of the coupling.

DETAILED DESCRIPTION

Figure 1:
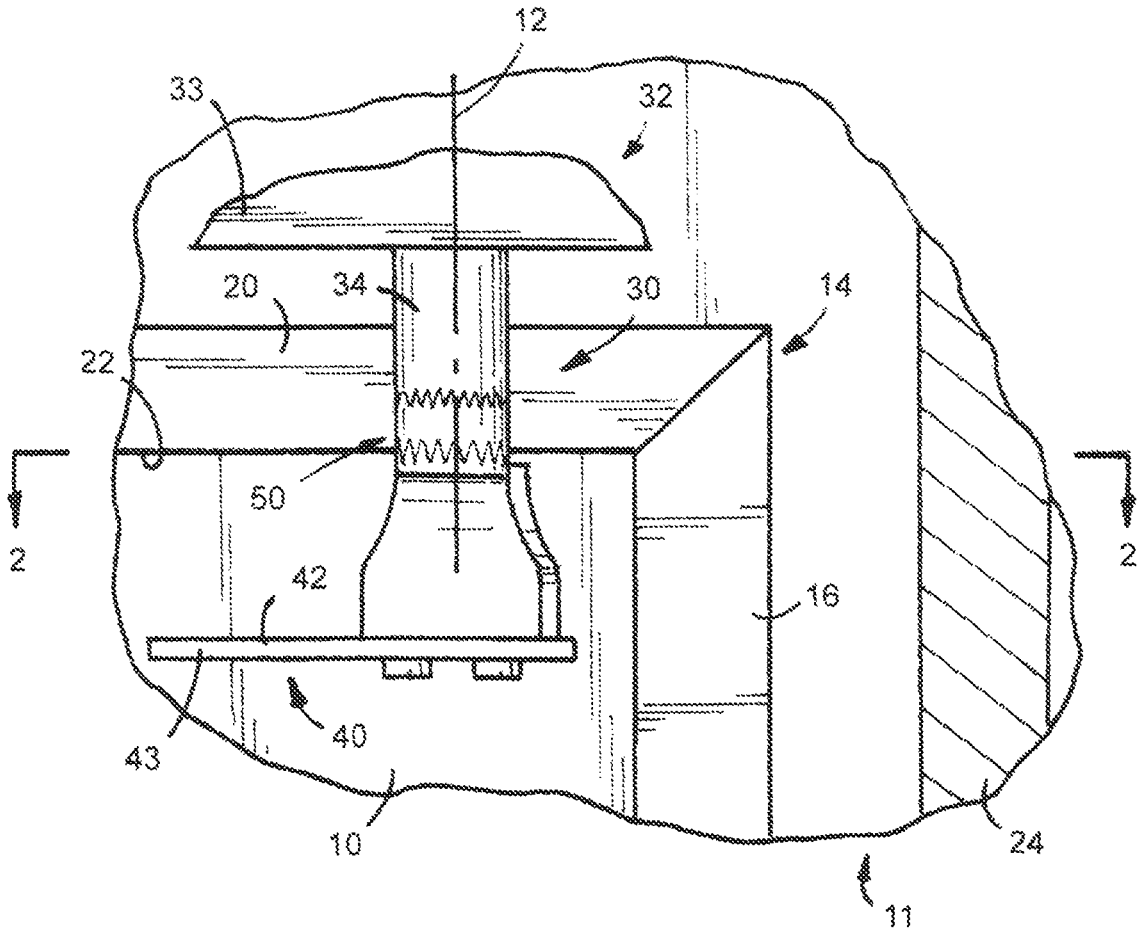
FIG. 1 is a schematic fragmentary illustration of a door arrangement operated under the influence of a door operating system embodying principals and teachings of this invention disclosure.

While this invention disclosure is susceptible of embodiment in multiple forms, there is shown in the drawings and will hereinafter be described a preferred embodiment, with the understanding the present disclosure is to be considered as setting forth an exemplification of the disclosure which is not intended to limit the disclosure to the specific embodiment illustrated and described.

Referring now to the drawings, wherein like reference numerals indicate like parts throughout the several views, FIG. 1 schematically illustrates one example of a door arrangement wherein a door operating system, which is the subject of this invention disclosure, finds utility. In the embodiment illustrated by way of example in FIG. 1, there is provided a door 10 which can move between open and closed positions to allow ingress and egress from a building, a walled room or other suitable space, generally indicated by reference numeral 11.

In one form, door 10 is mounted for pivotal movements about a generally vertical and stationary axis 12 in a frame 14 having upstanding side frame members 16 (with only one being shown for illustrative purposes) which are rigidly joined to each other by a header or top frame member 20. The frame members 16 and 20 combine to define an opening 22 allowing access to and from building 11. In the embodiment illustrated by way of example in FIG. 2, the building, walled room or other space 11 can often include a wall 24 extending generally perpendicular relative to a major plane of door 10 and arranged in proximate relation relative to the opening 22 defined by frame 14. In the embodiment illustrated by way of example in FIG. 2, the door 10 swings or pivots toward the side wall 24 as it moves from a closed and toward an open position.

Figure 2:
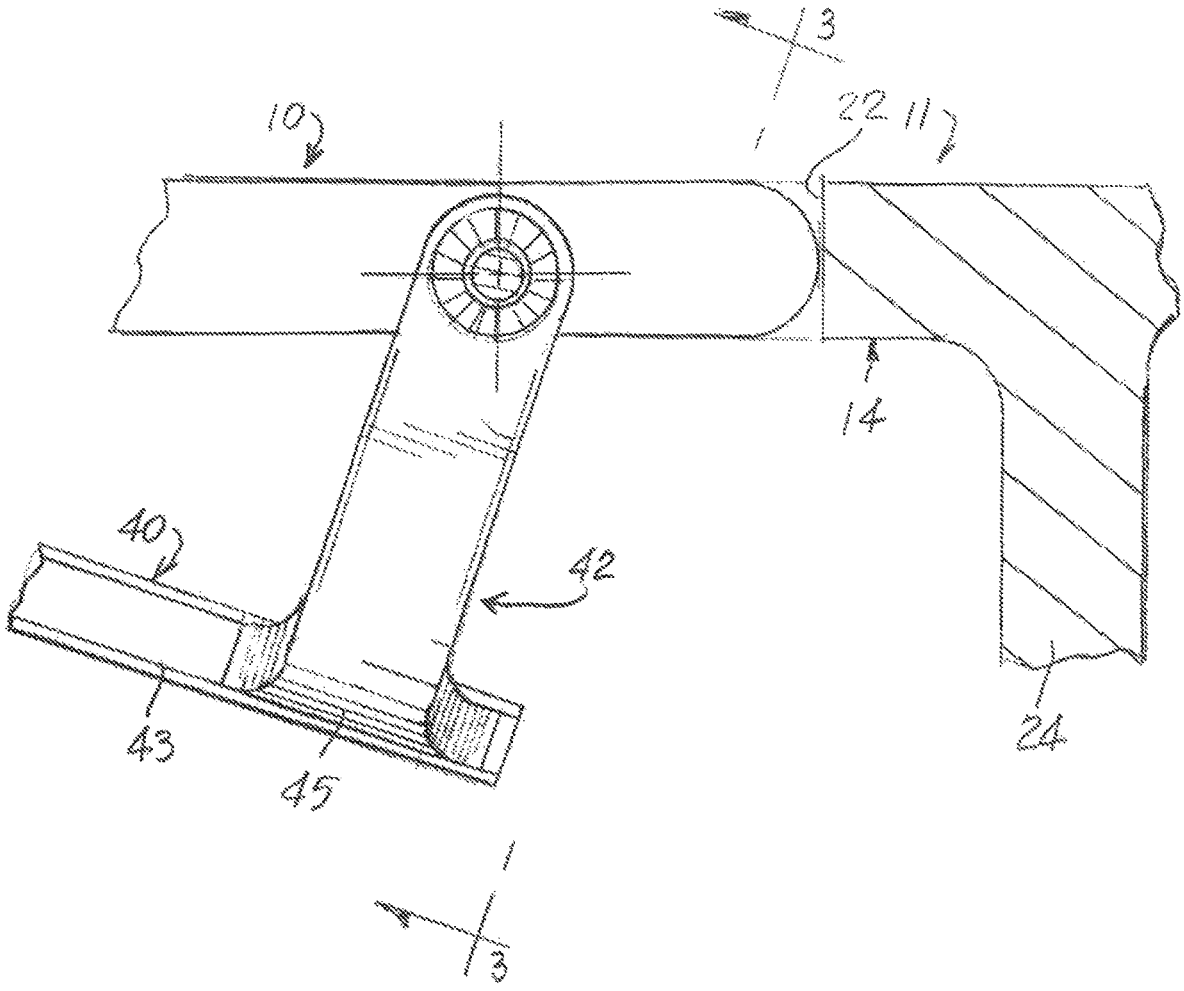
FIG. 2 is a sectional view taken along line 2-2 of FIG. 1.
Figure 3:
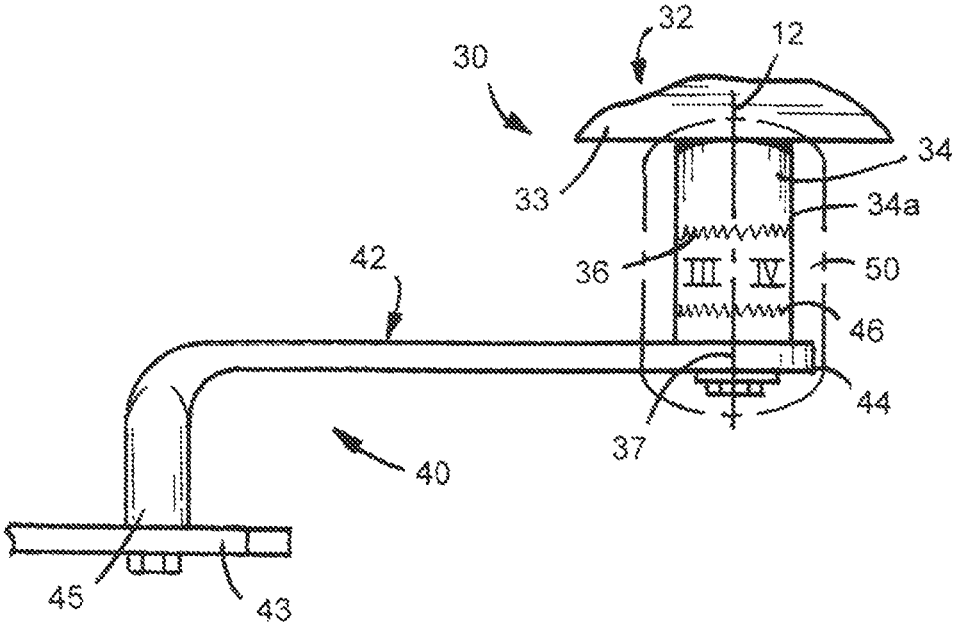
FIG. 3 is a view taken along line 3-3 of FIG. 2.

FIG. 3 illustrates one embodiment of this invention disclosure. As illustrated, the door operating system 30 of this invention disclosure is preferably structured and designed for repeatedly and consistently moving the door 10 (FIGS. 1 and 2) about the stationary axis 12 (FIG. 1) between closed and open positions. In the preferred embodiment illustrated in FIG. 3, the door operating system 30 includes a powered driver 32 suitably mounted and secured adjacent the header 20 of door frame 14 and proximate the axis 12 about which the door 10 pivots. In the illustrated embodiment, the powered driver 32 has a housing 33 and a positively driven output shaft 34 which extends outwardly of the housing 33 and terminates in a free-end 34*a*. The positively driven output shaft 34 of system 30 defines a fixed rotational axis 37. The free-end 34*a* of the output shaft 34 also defines a first end face 36 extending generally normal or perpendicular to the rotational axis 37 of shaft 34.

As further illustrated in FIG. 3, the door operating system 30 of this invention disclosure also includes linkage 40 operably disposed between the free-end 34*a* of the output shaft 34 of driver 32 and operably connected to the door 10 (FIGS. 1 and 2). In one form, linkage 40 includes a generally L-shaped rigid and free-ended crank arm 42 and a linkage arrangement 43 (FIG. 2) suitable to operably connect the crank arm 42 to door 10 (FIGS. 1 and 2).

As illustrated in FIG. 3, crank arm 40 is operably connected, toward one end 44 to the free-end 34*a* of the output shaft 34 of driver 32. An opposite or second free-end 45 of crank arm 42 is connected to and serves to move linkage arrangement 43 and, thus, door 10 (FIGS. 1 and 2), in the direction controlled by the driver 32. Also, the first end 44 of crank arm 42 defines an end face 46 extending generally parallel to the end face 36 on the output shaft 34 of the powered driver 32 when the crank arm 40 is attached to the output shaft 34 of driver 32. Moreover, and when the operating system 30 is operably connected to the door 10 (FIGS. 1 and 2), the first end 44 of the crank arm 40 directly underlies the free-end 34*a* of the output shaft 34 of system 30.

Figure 4:
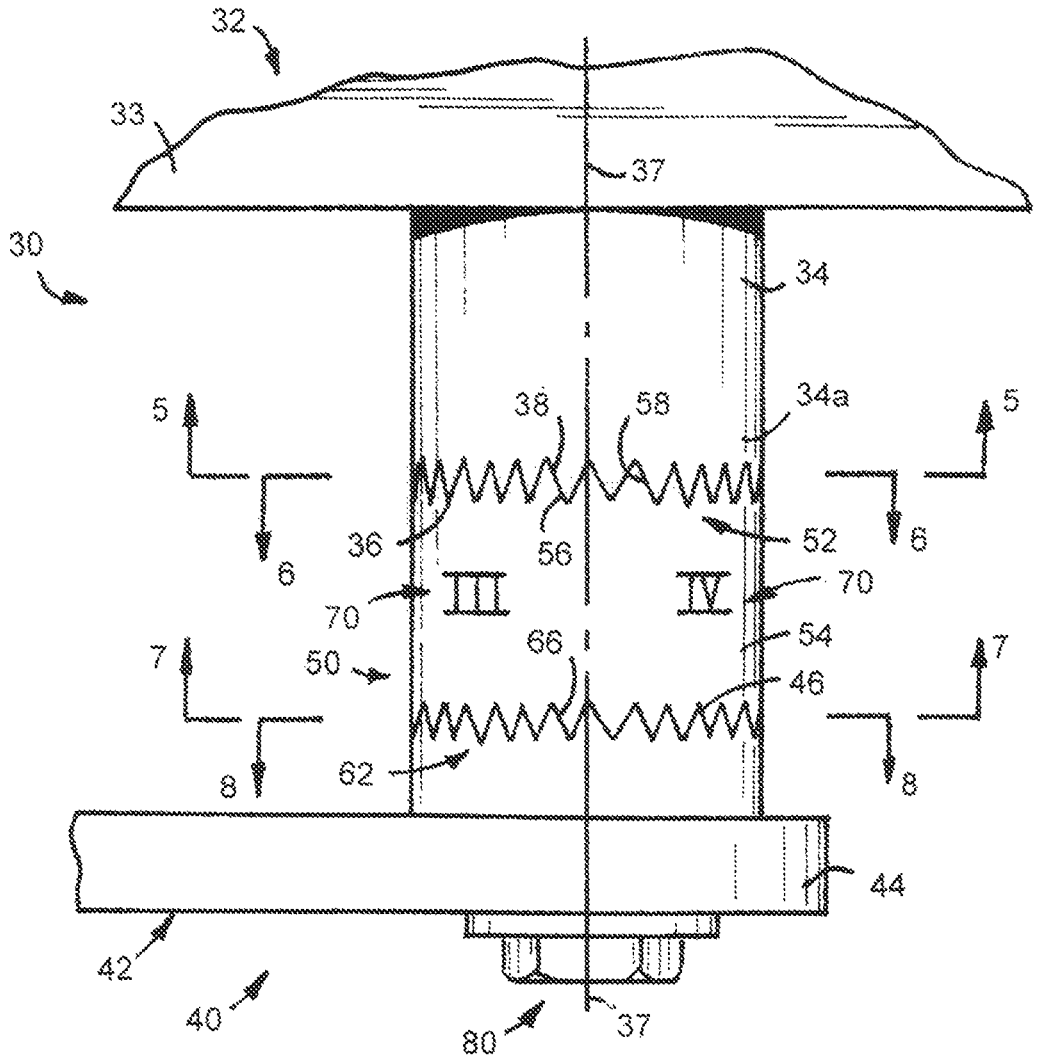
FIG. 4 is an enlarged side view of the area encircled by phantom lines in FIG. 3
Figure 10:
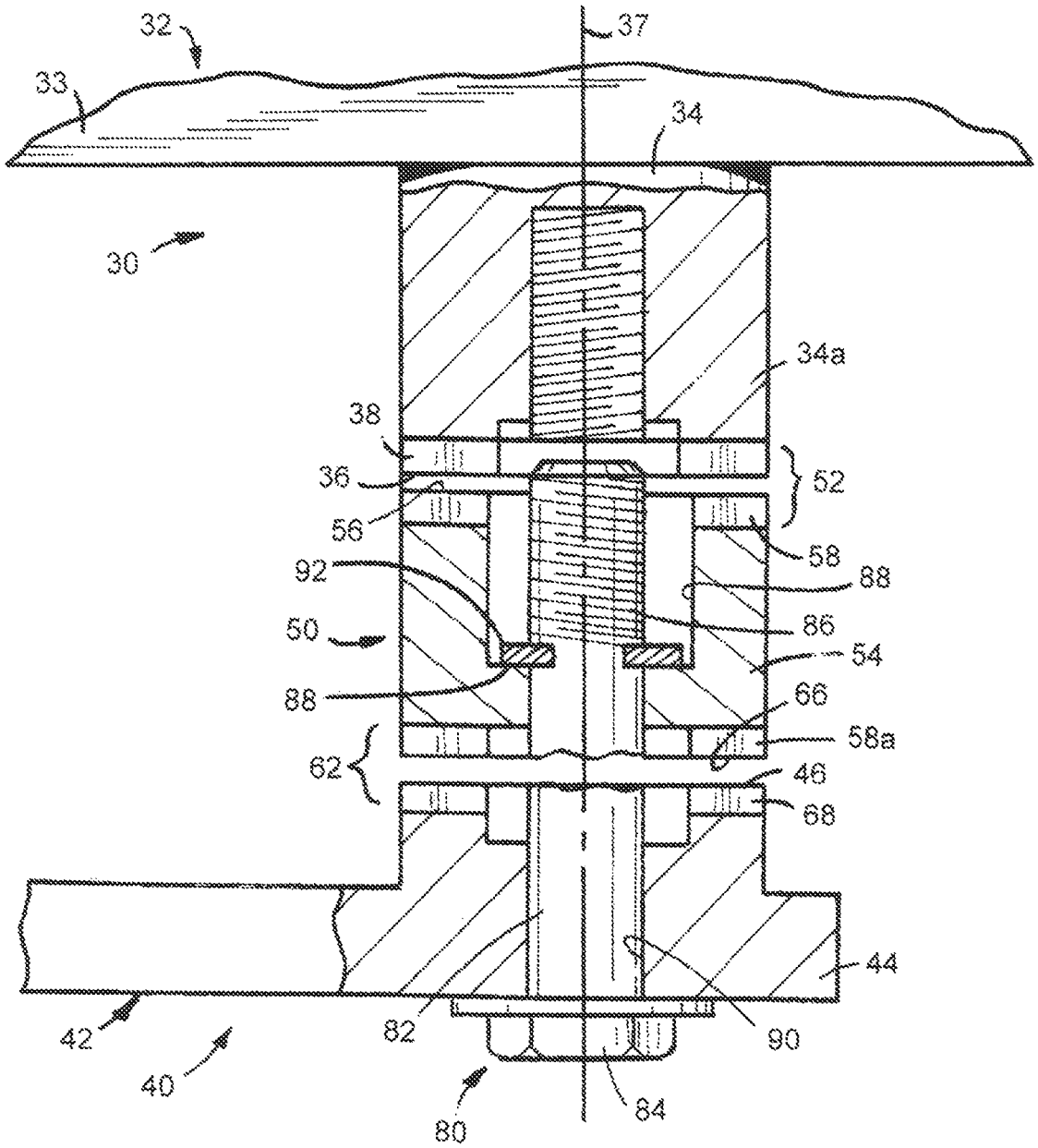
FIG. 10 is a fragmentary and enlarged sectional view similar to FIG. 4 showing a coupling of the present invention disclosure in an operational position.

According to one aspect of this invention disclosure, and as illustrated in FIG. 4, an adjustable and selectively operable coupling 50 is disposed between the free-end 34*a* of the output shaft 34 of driver 32 and the free-end 44 of crank arm 40. FIGS. 4 and 10 illustrate the adjustable coupling 50 in an operational relationship with the free-end 34*a* of the powered output shaft 32 and the crank arm 42. The adjustable coupling 50 has a pair of coaxially spaced and adjustable interfaces 52 and 62. The first adjustable interface 52 is defined between the free-end 34*a* of the output shaft 34 of driver 32 and coupling 50. The second adjustable interface 62 is defined between and toward the free or second end 44 of the crank arm 40 and the coupling 50 whereby allowing for a high resolution, angular adjustment of the position of door 10 (FIGS. 1 and 2).

On one embodiment, coupling 50 is configured as a metal ring 54 selectively rotatable about the axis 37 defined by the output shaft 34 of driver 32. The ring 54 of coupling 50 has at least third and fourth 56 and 66, respectively, axially spaced end faces thereon.

Figure 5:
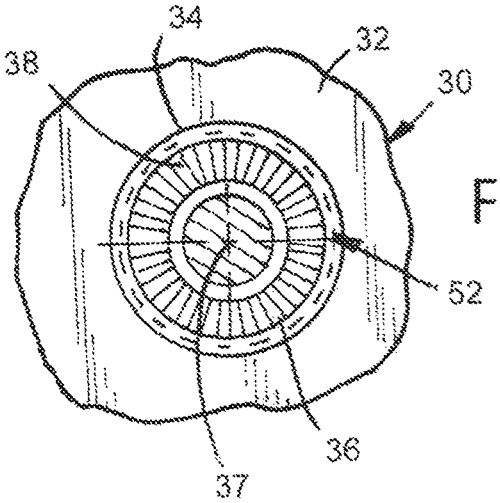
FIG. 5 is a view taken along line 5-5 of FIG. 4.
Figure 6:
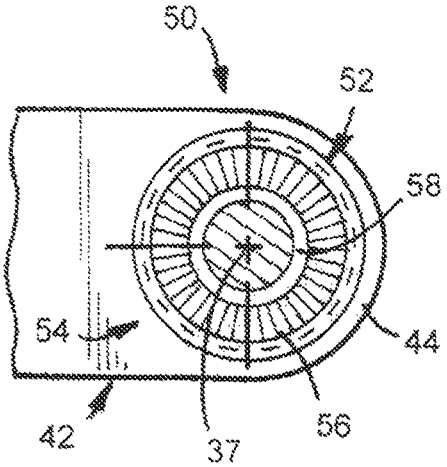
FIG. 6 is a view taken along line 6-6 of FIG. 4.
Figure 8:
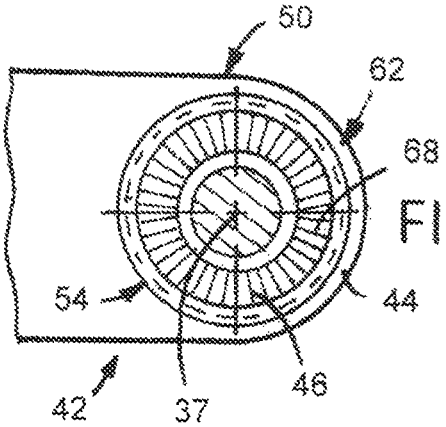
FIG. 8 is a view taken along line 8-8 of FIG. 4.

Turning to FIG. 5, the first adjustable interface 52 between the free-end 34*a* of the output shaft 34 of driver 32 and coupling 50 (FIG. 4) includes a predetermined number of engagement features 38 on the end face 36 of the output shaft 34 of driver 32. The engagement features 38 on the end face 36 of the output shaft 34 are configured to positively and mutually engage with a corresponding number of like and confronting engagement features 58 (FIG. 6) on the end face 56 defined by ring 54 of coupling 50 in any of a plurality of first distinct angularly indexed positions about fixed axis 37. As illustrated in FIGS. 5 and 6, the engagement features or elements 38 on the end face 36 of the output shaft 34 and the like engagement features or elements on the confronting end face 54 of coupling 50 included with the first interface 52 comprise a series of equally spaced, radial and intermeshing teeth which combine to define a first set of interlocking instrumentalities therebetween.

The second adjustable interface 62 between the five or second end 44 of crank arm 40 and coupling 50 includes a predetermined number of engagement features or elements 58*a* on the end face 66 of ring 54 of coupling 50. The engagement features or elements 58 on the end face 66 of ring 54 of coupling 50 are con figured to positively and mutually engage with a corresponding number of like engagement features or elements 68 on the confronting end face 46 defined toward the free-end 44 of crank arm 42 in any of a plurality of distinct angularly indexed positions about the fixed axis 37. Preferably, the engagement features or elements 58*a* on the end face 66 of ring 54 of coupling 50 and the like engagement features of element 68 on the end face 46 of crank arm 42 included with the second adjustable interface preferably comprises a series of equally spaced radial and intermeshing teeth which combine to define a second set of interlocking instrumentalities.

Figure 9:
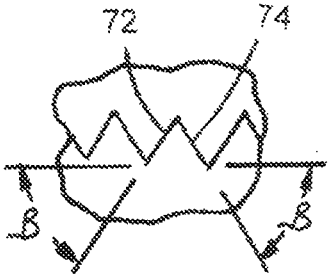
FIG. 9 is an enlarged view of the area encircled in phantom lines in FIG. 4.
Figure 7:
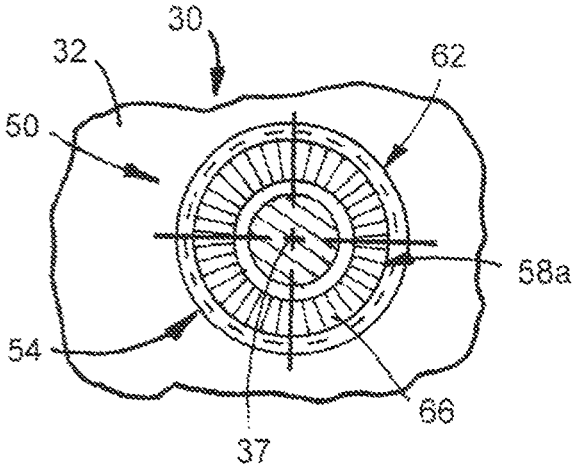
FIG. 7 is a view taken along line 7-7 of FIG. 4.

In one embodiment illustrated by way of example in FIG. 9, each tooth included with the first and second interfaces 52 and 62 (FIG. 4), respectively, (with only a few being shown for illustrative purposes) has a relative course design. Preferably, each tooth included with the first and second interfaces involves a symmetrical configuration which are identical relative to each other. As shown in FIG. 9, each serration or engagement feature included with the first and second interfaces (FIG. 4), respectively, has two bearing surfaces 72 and 74 which are acutely angled at about 60 degrees relative to a generally horizontal plane or surface from which each serration extends. In one form, the acute angle of each bearing surface 72 and 74 on each serration are generally equal to each other. Alternatively, however, the acute angle of bearing surface 72 can be different from the acute angle of bearing surface and 74 on each serration without detracting or departing from the spirit and scope of this invention disclosure. are generally equal to each other. Suffice it to say, the serration design beneficially offers a more positive transference of power or force over a longer period of time between the output shaft 34 of driver 32 and the crank arm 42 (FIG. 4) of linkage 40 resulting in less downtime and repair time for the door operating system 30 as compared to other door operating systems.

Preferably, and as mentioned above, the predetermined number of engagement features or elements 38 on the end face 36 of the output shaft 34 of driver 32 correspond in number to the predetermined number of engagement features or elements 58 on the end face 56 defined by ring 54 of coupling 50. Similarly, in a preferred embodiment, and as mentioned above, the predetermined number of engagement features or elements 58*a* on the end face 66 of ring 54 of coupling 50 correspond in number to the predetermined number of engagement features or elements 68 on the end face 46 defined toward the free-end 44 of crank arm 42. Notably, however, the predetermined number of engagement features or elements used in operable combination with and comprising the first adjustable coupling 52 is different from the predetermined number of engagement features or elements used in operable combination with and comprising the second adjustable coupling 62. As such, inadvertent reversal of the coupling 50 will become readily apparent during assembly of the door operating system.

In one embodiment set forth merely as an example, and in keeping with the preferable "course" tooth design of the interlocking instrumentalities, the first adjustable interface 52 of the door operating system 30 includes about 21 substantially identical, radially spaced, intermeshing and interlocking engagement features or elements used in operable combination therewith. Whereas, in one embodiment set forth merely as an example, the second adjustable interface 62 of the door operating system 30 includes about 19 substantially identical, radially spaced intermeshing and interlocking engagement features or elements used in operable combination therewith. It should be appreciated, however, the exact number of radially spaced intermeshing and interlocking engagement features or elements used in operable combination with the first and second adjustable interfaces 52 and 62 may not be exactly equal to that mentioned above. Suffice it to say, the number of radially spaced intermeshing and interlocking engagement features or elements used in operable combination with the first and second adjustable interfaces 52 and 62, respectively, are different from each other to affect the beneficial and desired ends of this invention disclosure.

As will be appreciated from an understanding of this invention disclosure, the difference in the number of radially spaced intermeshing and interlocking engagement features or elements used in operable combination with the first and second adjustable interfaces 52 and 62, respectively, yields several heretofore unknown advantages. First, the difference in number of radially spaced intermeshing and interlocking engagement features or elements used in operable combination with the first and second adjustable interfaces 52 and 62, respectively, inhibits inadvertent reversal of the coupling 50 during assembly of the door operating system 30. Second, the difference in the number of radially spaced intermeshing and interlocking engagement features or elements used in operable combination with the first and second adjustable interfaces 52 and 62, respectively, enhances the resolution and angular adjustment of the open position of door 10 (FIG. 2). That is, the difference in the number of radially spaced intermeshing and interlocking engagement features or elements used in operable combination with the first and second adjustable interfaces 52 and 62, respectively, allows the first and second angularly indexed positions of the first and second adjustable interfaces 52 and 62, respectively, to have different angular separations from each other whereby allowing for a high angular resolution for the open position of door 10 (FIG. 1). Moreover, such difference in the number of radially spaced intermeshing and interlocking engagement features or elements used in operable combination with the first and second adjustable interfaces 52 and 62, respectively, yields the possibility for numerous individual angular separations between the output shaft 34 of driver 32 and the crank arm 42 which were heretofore undiscovered and unobtainable.

Returning to FIG. 4, ring 54 of coupling 50 has different indicia or suitable markings 70 about a peripheral surface thereof. The indicia or markings 70 provide a visual indication of the angularly indexed setting for the coupling 50. That is, the indicia or markings 70 provide a visual indication of the relationship between the radially spaced intermeshing and interlocking engagement features or elements associated with the first and second adjustable interfaces 52 and 62, respectively, of coupling 50.

As illustrated by way of example in FIG. 4, the course teeth or elements operably associated with the first and second interfaces 52 and 62, respectively, of the door operating system 30 are mutually engagable and disengageable by means of relative axial movements of the coupling 50 along the axis 37 defined by the output shaft 34 of driver 32. In a preferred embodiment, illustrated by way of example in FIGS. 4 and 10, a locking mechanism 80 is provided to condition the door operating system 30 between an operational position or condition (FIGS. 4 and 10) and a non-operational position or condition illustrated in FIG. 11.

As will be readily appreciated by those skilled in the art, locking mechanism 80 can take any of a variety of different forms without detracting or departing from the spirit and scope of this invention disclosure. In one form, locking mechanism 80 includes an elongated fastener 82 having a head portion 84 and shank portion 86. Besides serving to condition the door operating system 30 between an operational position or locked condition (FIGS. 4 and 10) and a non-operational position or non-locked condition illustrated in FIG. 11, the preferred embodiment of locking mechanism 80 serves additional purposes. That is, in the preferred embodiment, the shank portion 86 of fastener 82 serves to maintain the first and second interfaces 52 and 62 along with the confronting end faces 36, 56 and 46, 66 in coaxial relationship relative to each other. Moreover, and as illustrated in FIG. 10, the ring 54 of the adjustable coupling 50 is journalled for rotation about the outer diameter of the shank portion 86 of fastener 82 whereby enhancing adjustable rotation thereof about axis 37.

In the embodiment illustrated in FIG. 10, at least a lengthwise portion of the shank portion 86 of fastener 82 is externally threaded and engages with internal threads defined by and opening to the free-end 34*a* of the powered drive shaft 34 of driver 32. Notably, the internal threads defined at the free-end 34*a* of the powered drive shaft 34 are coaxially aligned with axis 37. In one form, coupling 50 defines a bore 88 which coaxially aligns with axis 37 and opens to opposed end faces 56 and 66 of the coupling 50. Bore 88 defined by coupling 50 is preferably sized to allow the shank portion 86 of fastener 82 to axially slide therethrough. Also, the free-end 44 of crank arm 40 defines a bore 90 which opens to the end face 46 of arm 42 and to an opposed side of crank arm 49. Bore 90 is sized to allow the shank portion 86 of fastener 82 to axially slide therethrough while inhibiting the head portion 84 of fastener 82 to pass therethrough.

For reasons discussed below, and as illustrated by way of example in FIG. 10, the shank portion 86 of fastener is provided with a retaining ring 88. Ring 88 is spaced a predetermined axial distance from the free end of the shank portion 86 of fastener 82. Preferably, the retaining ring 88 serves as a limit stop and is configured to engage the powered drive shaft 34 when locking mechanism 80 is adjusted to a locked condition.

As will be appreciated from an understanding of this aspect of the invention disclosure, when the locking mechanism 80 conditions the door operating system 30 into a locked condition, the course teeth or elements operably associated with the first and second interfaces 52 and 62, respectively, of the door operating system 30 are clamped and maintained in a locked intermeshing relationship with the each other by rotating the locking mechanism 80 in a first direction whereby allowing a transfer of force or power between the output shaft 34 of driver 32 and the crank arm 42.

As will be appreciated from an understanding of this aspect of the invention disclosure, the locking mechanism 80 can easily and readily condition the door operating system 30 into a non-locked condition or position simply by rotating the fastener 82 in an opposite direction. That is, and as shown by way of example in FIG. 11, sufficient rotation of the fastener 82 in a direction opposite to the first direction which will result in the threaded shank portion 86 releasing from the internal threads associated with the drive shaft 34. As such, the teeth or interengaging elements 38 and 58 on the drive shaft 34 and adjustable coupling 50, respectively, can separate from each other so as to allow the angular indexed position between the drive shaft 34 and adjustable coupling 50 at the first adjustable interface 52 to be adjusted and changed.

In many instances, the door operating system 30 will be located in an elevated position. As such, when being conditioned into a non-operational position or condition, the threaded fastener 82 of locking mechanism can inadvertently separate from the assembled components and fall to the ground, thus, adding to the time required to repair or otherwise complete adjustment of the door operating system 30.

Figure 11:
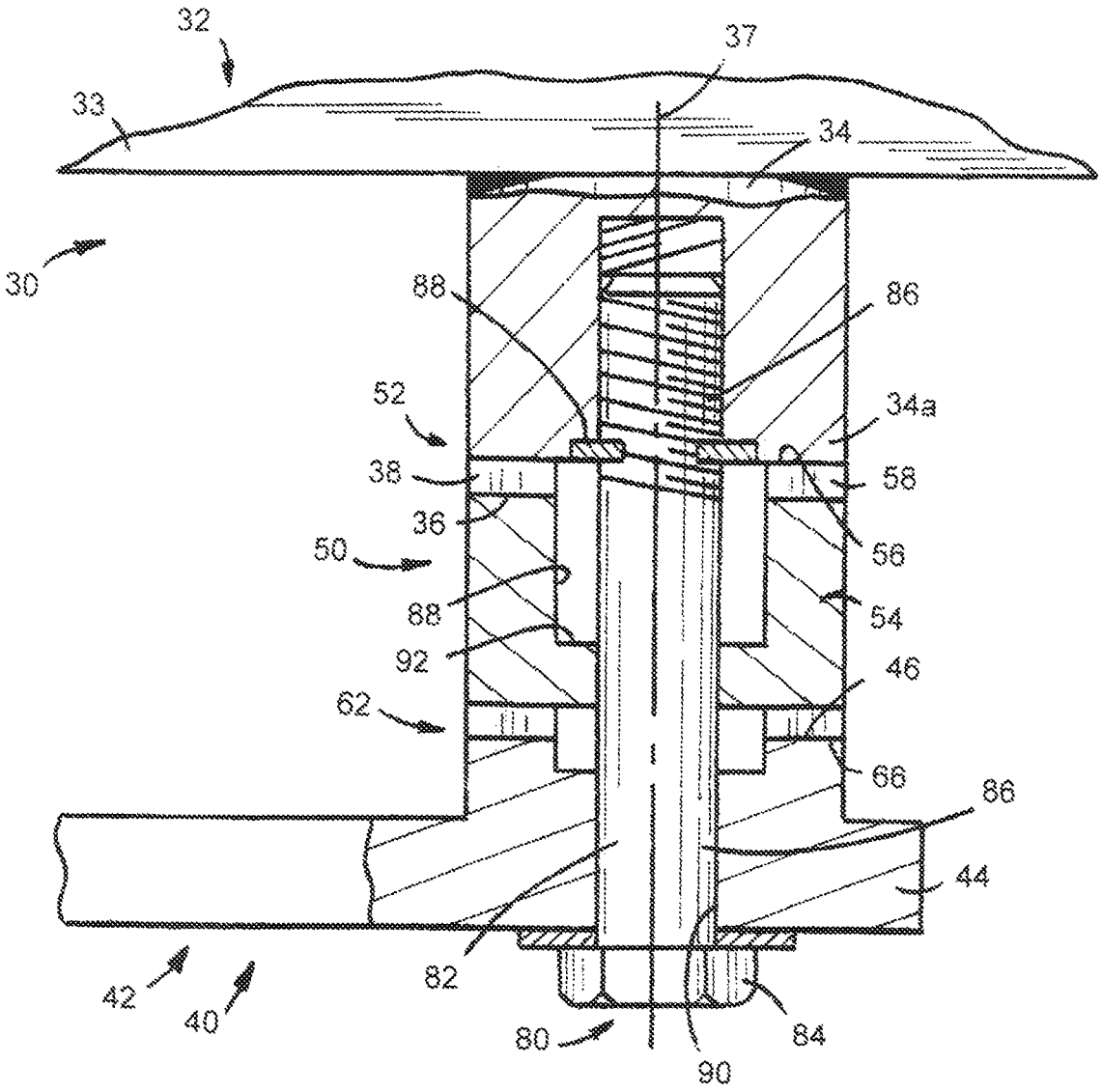
FIG. 11 is a fragmentary and enlarged sectional view similar to FIG. 10 showing the coupling of the present invention disclosure in a non-operational position.

In this regard, and as illustrated by way of example in FIGS. 10 and 11, the bore 88 defined by coupling 50 is preferably configured as a counterbore which defines a radial shoulder 92 spaced a predetermined axial distance from the end faces 56 and 66 of ring 54 of coupling 50. Absent retainer ring 88, after fastener 82 is unthreaded from the powered drive shaft 34, fastener 82 is normally free to fall from the coupling 50 and the end 44 of crank arm 42. With the present invention disclosure, however, after fastener 82 is unthreaded from the powered drive shaft 34, further travel of fastener 82 is limited. That is, and as schematically illustrated in FIG. 11, as the fastener 82 withdraws from the threaded connection with the drive shaft 34, the retainer ring 88 serves as a limit stop by engaging with the radial shoulder 92 defined on the coupling 50 and, thus, fastener 82 is inhibited from freely falling out of operable association with the coupling 50 and crank arm 42 of the door operating system 30.

The retaining ring 88 on fastener 82 and the radial shoulder on coupling 50 are configured such that, when the locking mechanism 80 conditions the door operating mechanism 30 into a non-locked condition or position, the teeth or interengaging elements 58*a* and 68 on the adjustable coupling 50 and the crank arm 42, respectively, can also separate relative to each other so as to allow the angular indexed position between the drive shaft 34 and crank arm 42 at the second adjustable interface 62 to be adjusted and changed to any of a plurality of angularly indexed positions if required and/or desired. As will be appreciated, the indicia 70 in the coupling 50 will again assist on setting the desired angular indexed positional relationship between the various and adjustable components comprising the door operating system 30.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A door operating system for moving a door about a vertical pivot axis between a closed position and an open position, said door operating system comprising:

a driver including a free-ended output shaft;

linkage operably connected to said door and to said output shaft of said driver; and an adjustable and selectively operable coupling disposed between the free-end of said output shaft of said driver and said linkage, with said adjustable and selectively operable coupling having a pair of coaxially spaced and adjustable interfaces, with a first adjustable interface being defined between the free-end of said output shaft and said adjustable and selectively operable coupling and a second adjustable interface being defined between said adjustable and selectively operable coupling and said linkage whereby allowing for a high resolution, angular adjustment of said door.

2. The door operating system according to claim 1, wherein the free-end of the output shaft defines a first end face extending generally normal to an axis defined by the output shaft of said driver, and wherein said linkage defines a second end face extending generally normal to the axis defined by the output shaft of said driver.

3. A door operating system for moving a door about a vertical pivot axis between a closed position and an open position, said door operating system comprising:

a driver including a free-ended output shaft defining an axis, wherein the free-end of the output shaft defines a first end face extending generally normal to the axis defined by the output shaft of said driver;

linkage operably connected to said door and to said output shaft of said driver, with said linkage defining a second end face extending generally parallel to the first end face defined by the output shaft of said driver; and an adjustable and selectively operable coupling disposed between the free-end of said output shaft of said driver and said linkage, with said adjustable and selectively operable coupling having a pair of coaxially spaced and adjustable interfaces, with a first adjustable interface being defined between the free-end of said output shaft and said adjustable and selectively operable coupling and a second adjustable interface being defined between said adjustable and selectively operable coupling and said linkage whereby allowing for a high resolution, angular adjustment of said door and, wherein said coupling defines a ring selectively rotatable about the axis defined by the output shaft of said driver and having third and fourth axially spaced end faces thereon.

4. The door operating system according to claim 3, wherein said first adjustable interface, defined between the free-end of said output shaft and said adjustable and selectively operable coupling, includes a predetermined number of engagement features on the first end face of said output shaft, with said engagement features being configured to engage with corresponding engagement features on an end face of said adjustable and selectively operable coupling.

5. The door operating system according to claim 4, wherein said second adjustable interface, defined between said adjustable and selectively operable coupling and said linkage, includes a predetermined number of engagement features on an end face of said linkage, with said engagement features on the end face of said linkage being configured to engage with corresponding engagement features on another end face of said adjustable and selectively operable coupling.

6. The door operating system according to claim 5, wherein the predetermined number of engagement features on the first end face of said output shaft which engage with the corresponding engagement features on said end face of said adjustable and selectively operable coupling is different in number than the predetermined number of engagement features on the end face of said linkage which engage with corresponding engagement features on said another end face of said adjustable and selectively operable coupling.

7. The door operating system according to claim 5, wherein the engagement features included with the first and second interfaces comprise a series of equally spaced, radial and intermeshing teeth.

8. The door operating system according to claim 7, with each tooth included with the first and second interface has a symmetrical serration including two load bearing surfaces each angled relative to the respective surface from which the serration extends.

9. A door operating system for repeatedly and consistently moving a door about a stationary pivot axis between a closed position and an open position, said door operating system comprising:

a driver including a positively driven free-ended output shaft rotatable about a fixed axis;

linkage operably connecting said door with the output shaft of said driver; and an adjustable coupling disposed between the free-end of said output shaft of said driver and said linkage, with said adjustable coupling having a pair of coaxially spaced interfaces, with a first adjustable interface including a first set of interlocking instrumentalities defined between the free-end of said output shaft and said adjustable coupling, with a first series of elements of said first set of interlocking instrumentalities being mutually engageable in a plurality of first distinct angularly indexed positions about the fixed axis of said output shaft, and with the first angularly indexed positions having a first angular separation, and with a second adjustable interface including a second set of interlocking instrumentalities defined between said adjustable coupling and said linkage, with a second series of elements of said second set of interlocking instrumentalities being mutually engageable in a plurality of second distinct angularly indexed positions about the fixed axis of said output shaft, and with the difference in the angularly indexed positions of the first and second adjustable interfaces allowing for a high angular resolution of the open position of said door.

10. The door operating system according to claim 9, with said adjustable coupling being configured for axial movement along the fixed axis of the output shaft of the driver so as to move the first and second series of elements of said first and second sets of interlocking instrumentalities, respectively, into mutually engageable and disengageable conditions relative to each other.

11. The door operating system according to claim 9, wherein the first series of elements of said first set of interlocking instrumentalities are provided by a series of teeth on an end face of the output shaft of said driver and by a confronting surface on said adjustable coupling.

12. The door operating system according to claim 11, wherein the first series of elements of said first set of interlocking instrumentalities includes a series of identical radially directed teeth.

13. The door operating system according to claim 9, wherein the second series of elements of said second set of interlocking instrumentalities are provided by a series of teeth on confronting surfaces defined by said adjustable coupling and said linkage.

14. The door operating system according to claim 13, wherein the second series of elements of said second set of interlocking instrumentalities includes a series of identical radially directed teeth.

15. A door operating system for repeatedly and consistently moving a door about a stationary pivot axis between a closed position and an open position, said door operating system comprising:

a driver including a positively driven free-ended output shaft rotatable about a fixed axis;

linkage operably connecting said door with the output shaft of said driver; and an adjustable coupling disposed between the free-end of said output shaft of said driver and said linkage, with said adjustable coupling having a pair of coaxially spaced interfaces, with a first adjustable interface including a first set of interlocking instrumentalities defined between the free-end of said output shaft and said adjustable coupling, with a first series of elements of said first set of interlocking instrumentalities being mutually engageable in a plurality of first distinct angularly indexed positions about the fixed axis of said output shaft, and with the first angularly indexed positions having a first angular separation, and with a second adjustable interface including a second set of interlocking instrumentalities defined between said adjustable coupling and said linkage, with a second series of elements of said second set of interlocking instrumentalities being mutually engageable in a plurality of second distinct angularly indexed positions about the fixed axis of said output shaft, and with the difference in the angularly indexed positions of the first and second adjustable interfaces allowing for a high angular resolution of the open position of said door, and wherein said adjustable coupling defines a ring selectively rotatable about the fixed axis defined by said free-ended output shaft.

16. The door operating system according to claim 15, wherein a circumference of said ring of said adjustable coupling includes indicia for visually indicating the indexed position of said adjustable coupling.

17. A door operating system for repeatedly moving a door about a stationary pivot axis between a closed position and an open position, said door operating system comprising:

a driver including a positively driven free-ended output shaft defining a fixed axis;

a linkage including a generally L-shaped crank arm operably connected to and extending from said door toward the free-end of said output shaft; and an adjustable coupling disposed between the free-end of said output shaft of said driver and said crank arm, with said adjustable coupling having first and second coaxially spaced interfaces, with a first adjustable course toothed interface being defined by said first interface between the free-end of said output shaft and said adjustable coupling, and a second adjustable course toothed interface being defined by said second interface between said adjustable coupling and said crank arm whereby allowing for angular adjustment of the open position of said door as a function of the adjusted position of said adjustable coupling relative to said output shaft and said crank arm.

18. The door operating system according to claim 17, wherein said first toothed interface includes a first predetermined number of radially spaced course teeth on an end face of said output shaft and an equal number of radially and equally spaced teeth on a first surface of said adjustable coupling.

19. The door operating system according to claim 18, wherein said second toothed interface includes a second predetermined number of radially spaced course teeth on a second surface of said adjustable coupling and an equal number of radially and equally spaced teeth on said crank arm.

20. The door operating system according to claim 19, wherein the first and second predetermined number of teeth on the first and second interfaces are not equal to each other whereby allowing for angular adjustment of the open position of said door as a function of the adjusted position of said adjustable coupling relative to said output shaft and said crank arm.

21. The door operating system according to claim 17, with said adjustable coupling being configured for axial movement along the fixed axis of the output shaft of said driver so as to move the course teeth of said first and second interfaces into mutually engageable and disengageable conditions relative to each other.

22. The door operating system according to claim 17, further including a locking mechanism for conditioning said door operating system in a locked condition, wherein the teeth of said first and second interfaces are maintained in releasably locked intermeshing relation relative to each other whereby allowing force transfer therebetween, and an unlocked condition.

23. A door operating system for repeatedly moving a door about a stationary pivot axis between a closed position and an open position, said door operating system comprising:

a driver including a positively driven free-ended output shaft defining a fixed axis;

a linkage including a generally L-shaped crank arm operably connected to and extending from said door toward the free-end of said output shaft; and an adjustable coupling disposed between the free-end of said output shaft of said driver and said crank arm, with said adjustable coupling having first and second coaxially spaced interfaces, with a first adjustable course toothed interface being defined by said first interface between the free-end of said output shaft and said adjustable coupling, and a second adjustable course toothed interface being defined by said second interface between said adjustable coupling and said crank arm whereby allowing for angular adjustment of the open position of said door as a function of the adjusted position of said adjustable coupling relative to said output shaft and said crank arm, and wherein said adjustable coupling defines a ring selectively rotatable about the fixed axis of said output shaft of said driver.

24. The door operating system according to claim 23, wherein a circumference of said ring includes indicia for visually indicating the indexed position of said adjustable coupling.

* * * * *